United States Patent [19]

Conway

[11] Patent Number: 5,012,125

[45] Date of Patent: Apr. 30, 1991

[54] SHIELDED ELECTRICAL WIRE CONSTRUCTION, AND TRANSFORMER UTILIZING THE SAME FOR REDUCTION OF CAPACITIVE COUPLING

[75] Inventor: David W. Conway, Cedar Rapids, Iowa

[73] Assignee: Norand Corporation, Cedar Rapids, Iowa

[21] Appl. No.: 57,956

[22] Filed: Jun. 3, 1987

[51] Int. Cl.[5] ..... H01B 7/18

[52] U.S. Cl. ..... 307/149; 307/150; 336/180; 336/229; 174/36; 174/120 SC

[58] Field of Search ..... 307/106, 107, 108, 109, 307/110, 412, 413, 414, 415, 416, 417, 418, 149, 326; 336/180, 186, 213, 221, 219, 205, 206, 224, 177, 171, 218; 363/132, 133, 134, 25, 26, 24, 180–186, 192, 193, 195, 205, 206, 208, 220, 229, 230, 231; 323/241, 290, 272, 329; 328/65, 67, 155, 156, 162; 174/36, 102 SC, 105 SC, 106 SC, 120 SC, 115, 107, 117 F, 117 FF

[56] References Cited

U.S. PATENT DOCUMENTS

| | | | |
|---|---|---|---|
| 1,972,319 | 9/1934 | Rypinski | 336/182 X |
| 2,316,370 | 4/1943 | Smith et al. | 336/182 |
| 3,098,893 | 7/1963 | Pringle et al. | 174/102 SC |
| 3,149,296 | 9/1964 | Cox | 336/229 X |
| 3,243,750 | 3/1966 | Collins | 336/229 X |
| 3,588,776 | 6/1971 | Horwinski | 174/115 X |
| 3,622,683 | 11/1971 | Roberts | 174/36 |
| 3,639,860 | 2/1972 | Breitenbach | 336/180 X |
| 3,665,096 | 5/1972 | Madle | 174/36 X |
| 3,794,750 | 2/1974 | Garshick | 174/36 |
| 3,843,829 | 10/1974 | Bridges et al. | 174/36 |
| 3,927,247 | 12/1975 | Timmons | 174/36 |
| 4,025,715 | 5/1977 | Foley et al. | 174/120 SC X |
| 4,131,758 | 12/1978 | Felkel | 174/107 |
| 4,360,704 | 11/1982 | Madry | 174/36 |
| 4,360,704 | 11/1982 | Madry | 174/36 |
| 4,551,700 | 11/1985 | Waldemar | 336/192 |
| 4,631,511 | 12/1986 | Sylvester et al. | 336/180 |
| 4,777,324 | 10/1988 | Lee | 174/36 |

*Primary Examiner*—Paul Ip

*Attorney, Agent, or Firm*—Neuman, Williams, Anderson & Olson

[57] ABSTRACT

A current carrying wire is provided with a tubular shield construction which essentially covers the wire with conductive material, and preferably emulates a classical Faraday shield. The shield is formed of a multiplicity of insulated shield wires for minimized eddy current loss. When such a shielded wire construction is formed into a primary winding of a power transformer for a switching power supply, the secondary circuit is protected from electric shock hazards while enabling use of a gap free toroidal core for close coupling between primary and secondary windings. In another embodiment, such shields are used on both the primary and secondary windings of a matching transformer and are arranged for common mode rejection of noise associated with low power data signals.

52 Claims, 1 Drawing Sheet

FIG.1
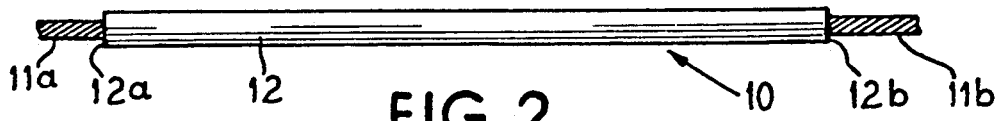
FIG.2
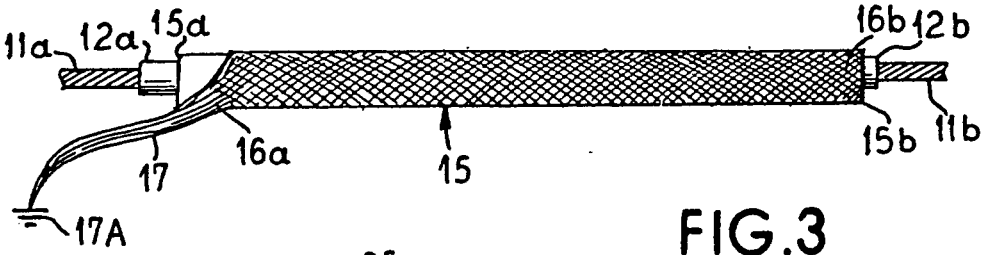
FIG.3
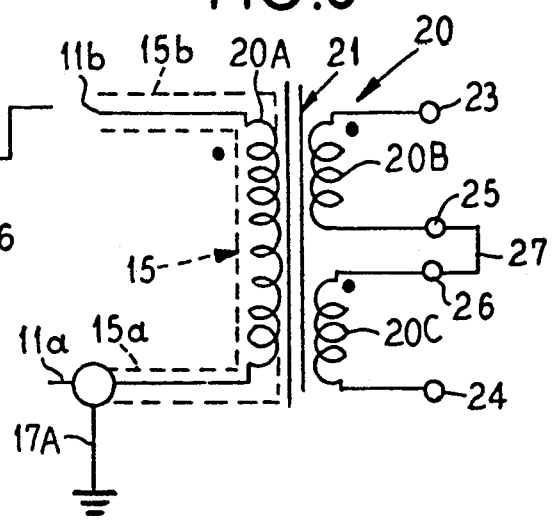
FIG.4
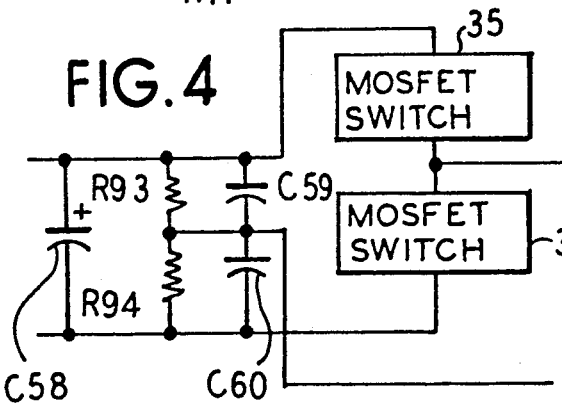
FIG.5
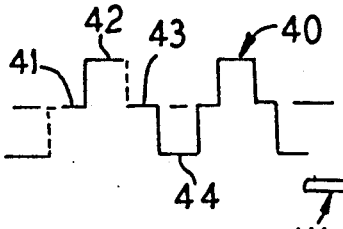
FIG.6
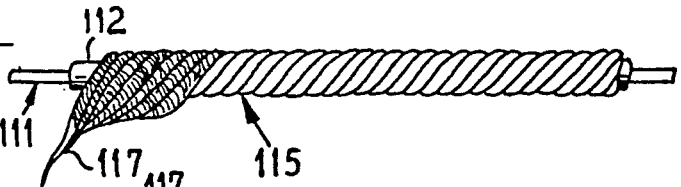
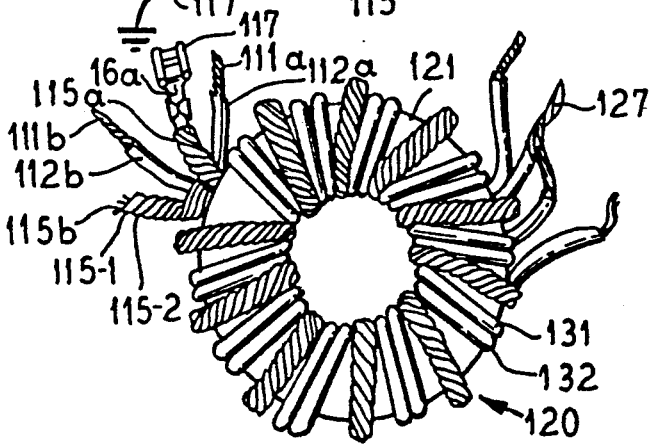
FIG.7

SHIELDED ELECTRICAL WIRE CONSTRUCTION, AND TRANSFORMER UTILIZING THE SAME FOR REDUCTION OF CAPACITIVE COUPLING

BACKGROUND OF THE INVENTION

This invention relates to a shielded wire construction, and particularly to such a construction wherein a helically wound central conductor has a special shield configuration extending helically with and substantially enclosing the central conductor, and providing the properties of a Faraday shield therefor.

A classical Faraday shield takes the form of a planar array of spaced parallel conductors grounded at one end. Such a configuration is found to have desirable shielding properties.

In the field of switching power supplies, it is common to use a transformer with E-shaped cores so that a flat sheet of copper can be inserted between the primary and secondary windings. Such shielding between primary and secondary circuits is for the purpose of electric shock protection pursuant to Underwriters Laboratories Requirements for Electronic Data Processing Units and Systems, paragraph 9A of UL 478, fifth edition.

SUMMARY OF THE INVENTION

An object of the invention is to provide a shielded wire construction especially useful in switching power supply constructions.

A shielded wire in accordance with the present invention has been used in a transformer construction for a switching power supply for meeting paragraph 9A requirements of Underwriters Laboratory provision UL 478, fifth edition.

A further object of the present invention is to provide a shielded wire construction which when embodied as the primary winding of a transformer of a switching power supply, reduces the stray capacitance between turns of the primary winding, so as to minimize stress on switching elements in the primary circuit and electromagnetic interference generated by the switched operation of the primary circuit.

Another object of the invention resides in the provision of a shielded wire construction for transformers which markedly reduces stray capacitance from the primary winding to the secondary winding, thereby drastically reducing the coupling of incoming noise or transients to the secondary circuit.

In a preferred wire construction, a primary conductor with a high quality insulating covering is essentially enclosed by a tubular shield configuration formed of insulated shield wires.

Still another object of the present invention is to provide a transformer configuration providing greatly improved inductive coupling between the primary and secondary windings with minimized eddy current losses, while yet meeting stringent requirements for the protection of the secondary circuit against electric shock hazards.

Another and further object of the invention is to provide a transformer configuration achieving greatly enhanced inductive coupling and yet essentially meeting high standards of noise isolation, such as the Class B requirements of Part 15J of section 47 of the regulations of the Federal Communications Commission (FCC CFR 47. Pt 15J).

In a successful implementation of the invention, the shield wires are provided with individual insulating coverings and then interwoven into a braided tubular shield configuration wherein the shield wires at one end of the shield are insulated from each other while at the opposite end the bare conductors of the respective shield wires are electrically connected in common to ground potential. Such a shield may enclose ninety-five percent of the central conductor being shielded and may provide the properties of a Faraday shield, effectively diverting spurious primary signals to ground.

In a particular transformer construction which has been successfully operated the turns of the secondary windings are wound on a toroidal magnetic core in interleaved relation to the specially shielded primary winding, the shield configuration of the primary winding providing the properties of a grounded Faraday shield.

Other objects features and advantages of the present invention will be apparent from the following detailed description taken in connection with the accompanying drawings, and from the respective features of the appended claims.

BRIEF DESCRIPTION OF THE DRAWINGS

FIG. 1 is a diagrammatic view illustrating an exemplary insulated electrical conductor which may be utilized as the signal current carrying conductor of a shielded wire construction in accordance with the present invention;

FIG. 2 is a somewhat diagrammatic view illustrating a shielded wire construction in accordance with the present invention wherein the insulated electrical conductor of FIG. 1 is surrounded by a tubular shield of special configuration to form an embodiment of the shielded wire construction of the present invention;

FIG. 3 is a diagrammatic electric circuit illustration of a transformer wherein the primary winding is formed utilizing a shielded wire construction such as illustrated in FIG. 2;

FIG. 4 shows a portion of a switching power conversion circuit for driving the transformer configuration of FIG. 3;

FIG. 5 shows an exemplary driving voltage waveform as a function of time which may be produced by the circuit of FIG. 4, and applied to the transformer configuration of FIG. 3;

FIG. 6 shows an early hand-wound shield configuration wrapped on the primary wire of FIG. 1; and FIG. 7 is a schematic plan view illustrating a toroidal transformer construction which is a physical embodiment of the electric circuit diagram of FIG. 3, and which by way of example, may be formed utilizing the shielded wire configuration of FIG. 6.

DETAILED DESCRIPTION

FIG. 1 illustrates an exemplary illustrated wire 10 which may be advantageously utilized in the shielded wire construction of FIG. 2. By way of specific preferred example, the wire 10 may comprise nineteen strands of number twenty-nine A.W.G. silver-plated copper wires forming a stranded conductor 11. Conductor 11 is shown as having a tubular insulating cover 12 except at respective ends 11*a* and 11*b*. By way of example, the stranded conductor 11 may be of a cylindrical cross section and of continuous uniform construction throughout its length including the ends 11*a* and 11*b*. Simply by way of example, the insulating covering 11 is of annular cross section and may have an outside diameter of about 0.077 inch where the overall diameter of the stranded conductor 11 is about 0.0565 inch, the wall thickness of the covering then being approximately ten mils where one mil equals 0.001 inch, ten mils corresponding to about one-fourth millimeter. In one specific successful embodiment, the insulating covering 12 was of FEP Teflon (fluorinated ethylene propylene Teflon). The ends of the insulating covering 12 have been designated 12*a* and 12*b* in FIG. 1, and these ends 12*a* and 12*b* have been indicated as protruding slightly from the special shield configuration 15 of FIG. 2 so as to show the construction with greater clarity. The shield configuration in the illustrated embodiment is tubular and snugly fits over the outside perimeter of the insulating covering 12 of the conductor 10. For the sake of an illustrative practical embodiment, the insulating covering 12 would be of a high quality dielectric material with low losses at a signal frequency such as forty-four kilohertz. A suitable wire of this type is available as part number N22-29S-250 of the New England Electric Wire Corporation.

Referring to FIG. 2, the special shield configuration 15 in the illustrated embodiment is formed of a multiplicity of individually insulated shield wires such as diagrammatically indicated at 16, the wires being interwoven into a tubular braided configuration closely surrounding the periphery of the insulation covering 12 as previously explained. In a specific example, the shield 15 was formed of a four by seven pattern of number forty A.W.G. shield wires, each shield wire having its conductor Nyleze insulated before construction of the braid. In an exemplary successful construction, the conductive material of the shield wires covered substantially ninety-five percent of the exterior of the electrical conductor 10. In this example, each shield wire may have a copper core conductor with a first insulating layer of polyurethane and with an overcoat of Nylon. In an example which meets less stringent requirements, the Nylon overcoat may be omitted. The special shield construction 15 of FIG. 2 should not be confused with existing braided shields in which each strand is a bare wire which is not insulated from adjacent wires.

In the illustrated successful embodiment, at a first end 15*a* of the shield 15, the bare ends of the shield wire conductors, such as indicated at 16*a*, are tinned, and the tinned bare conductor ends of the shield wires of shield 15 are electrically secured together to form a ground lead 17 which is connected to chassis ground. At the opposite end 15*b* of the shield 15, each of the shield wires has its end such as indicated 16*b* disposed in open circuit insulated relationship to all of the other ends of the respective shield wires, so that only the ends such as 16*a* at the first end 15*a* of the shield are connected directly to ground. By way of example, for the case of twenty-eight shield wires forming the tubular braided shield construction, there would be twenty-eight respective ends such as 16*b* at the end 15*b* of the shield 15 adjoining the end 12*b* of insulating covering 12. The ends such as 16*b* may be epoxy insulated so that no bare conductive material is exposed at this end 15*b* of the shield; or this end of the shielded wire construction may be impregnated, for example by means of a vacuum impregnation process, where the shielded wire construction is formed into a primary winding of a transformer. The shield configuration 15 has the properties of a classical Faraday shield comprised of a planar array of straight conductors connected at one end to ground.

FIG. 3 illustrates a transformer construction 20 wherein the primary winding 20A is formed from the shielded wire construction of FIG. 2. Corresponding parts in FIGS. 1, 2 and 3 have been given the same reference numerals. In particular, the primary winding 20A is formed by conductor 11 of the wire 10 of FIG. 1, and the shield 15 is diagrammatically indicated by dash lines in FIG. 3 with the shield end 15*a* being indicated adjacent bare conductor end 11*a*, and shield end 15*b* being indicated adjacent bare conductor end 11*b*. While it is not feasible to so illustrate in FIG. 3, the shield 15 of course follows along each helical turn of the conductor 11, and for example the shielded wire construction 15 of FIG. 2 may be helically wound on a magnetic core such as indicated at 21 in FIG. 3 so that each turn of the shielded wire construction 15 encircles and physically links the cross section of the magnetic core. In the actual physical construction, the magnetic core 21 is of toroidal or annular shape, and the shielded wire construction 15 of FIG. 2 is wrapped helically on the toroidal magnetic core to form a toroidal primary winding. The secondary winding in FIG. 3 is shown as comprising secondary winding sections 20B and 20C having outside terminals 23 and 24 and inner terminals 25 and 26 connected by conductor 27. In preferred physical constructions according to FIG. 3, the primary and secondary windings both physically encircle a gap-free loop magnetic flux path. If the primary and secondary windings are wound on opposite sides of a toroidal core, this reduces capacitive coupling but results in relatively poor inductive coupling and a relatively large amount of leakage inductance. For power applications such a high leakage winding arrangement would be very disadvantageous, so that it has been difficult to achieve a power transformer with both low capacitive coupling and a high degree of inductive coupling. With a primary winding having an integrated shield configuration according to the present invention, however, it is feasible to have the secondary winding encircling the same section of magnetic core which is encircled by the primary winding so as to attain excellent inductive coupling between the primary and secondary windings, without detrimental capacitive coupling. In one preferred embodiment, a single layer secondary winding encircles the magnetic core directly over the primary winding with each turn of the secondary winding separated from the primary wire essentially only by the radial (thickness) dimension of the shield; in this example a single layer primary winding may helically encircle the entire length of a toroidal core and may have only a single layer of insulating tape wrapped thereon, after which the secondary winding is helically wound in a single layer directly on the primary winding with its integrated shield construction. In a second example physically close primary and secondary windings with low capacitive coupling are achieved as shown in FIG. 7 where the primary and secondary windings are wound about a gap-free toroidal core in interleaved relation. In this second example, the shield construction on each primary turn is located between the turns provided by the secondary wires. The shield 15 in the physical construction of the transformer of FIGS. 1, 2 and 3 prevents a high voltage arc from occurring between the primary conductor 11 and the secondary winding or windings as well as reducing capacitance between the primary and secondary windings.

The transformer of FIGS. 1, 2 and 3 has been successfully employed in a switching power supply wherein the transformer was operated at forty-four kilohertz. The power supply is identified as Norand Corporation Model NCA180 which is operated either from 120 volts at sixty hertz, or from a twenty-four volt battery, and comprised an AC to DC half-bridge converter. An input rectifier charges filter capacitor C58 which supplies plus one hundred and sixty volts DC across two anti-saturation capacitors such as C59 and C60, FIG. 4. The connection point between the two anti-saturation capacitors is connected to one side of primary winding, e.g. at 11*a*, FIG. 3. The connection point between two MOSFET switch circuits 35 and 36 is connected e.g. via a current sense element (not shown) to the other side of the primary winding, e.g. 11*b*, FIG. 3. The capacitors C59 and C60 may each have a capacitance value of 2.2 microfarads (250V), and resistors R93 and R94 may each have a resistance value of twenty-two kilohms (0.5 watt, 10%). A series circuit comprised of a six hundred and eighty picofard capacitor (C67, 680PF, 500V) and a one hundred and fifty ohm resistor (R100, 150 ohms, one watt, 5%) is connected across the primary winding 20A, i.e. between conductors 11*a* and 11*b*, FIG. 3. As will be understood by those skilled in the art, the switch circuits 35 and 36 provide a voltage waveform such as shown at 40 in FIG. 5 to the primary winding 20A, the switch 35 being turned on after a dead time at 41 of three to six microseconds to provide a plus seventy-nine to eighty-eight volt driving pulse as indicated at 42 and the switch 36 being alternately turned on after a dead time at 43 of three to six microseconds to provide a minus seventy-nine to eighty-eight volt driving pulse as indicated at 44. The duration of each driving pulse such as 42 and 44 may be modulated e.g. at the respective trailing edges such as indicated by dotted lines in FIG. 5, to regulate the filtered output voltage to a desired value, e.g. plus twenty-eight volts. By way of example, the maximum duty cycle of the driving pulses such as 42 and 44 may be 81%, while for high line voltage, the minimum duty cycle may be 45%. The maximum duty cycle may correspond with a low AC line voltage having a rms value of eighty-five volts (85 VAC), and the minimum duty cycle may correspond with a high AC line voltage having a rms value of one hundred and thirty-six volts (136 VAC). The secondary supplies peak voltage values between fifty and sixty volts with the same dead zones of between three and six microseconds. The apparent power rating of the transformer was 330 watts. In the specific Model NCA180 power supply described herein, an output rectifier and inductor are connected to the secondary windings 20B and 20C, and output voltage for regulation purposes is taken between the output inductor (L3, 130 microhenries) and an output filter capacitor (C64, 1000 microfarads, 50V). The pulse width modulator regulator circuit utilized for controlling switches 35 and 36 supplied forty-four thousand cycles such as 41–44, FIG. 5, per second. Up to eight amperes peak at twenty-eight volts is generated from the 120 VAC line. The primary winding 20A used Teflon for insulation 12 and was close wound as a single layer on a toroidal core with a magnetic path length of 3.53 inches (8.97 centimeters) and an effective core cross sectional area of 0.15 square inches (0.968 $cm^2$). Twenty-one turns were found to make one complete layer around the toroidal core 21, and the operating frequency of forty-four kilohertz resulted from the characteristics of the toroidal core with this number of primary turns. The secondary windings 20B and 20C were each fifteen turns and were wound to make one evenly spaced layer. By way of example, the tubular shield 15 was formed of four groups of twisted wires, each group being formed of seven strands of No. 40 AWG copper wire with Nyleze insulation. By way of example, the Nyleze insulation coating may have a thickness of 0.4 mil. A tubular braided shield of such a four by seven No. 40AWG construction with a single Nyleze insulating coating is considered to provide ninety-five percent conductive coverage of the central conductor being shielded. By way of example, the toroidal magnetic core 21 was formed of a monolithic ferrite material sintered under high pressure, such as Ferroxcube part number 500XT6003C8, with an initial permeability at twenty-five degrees centigrade (measured one hundred kilohertz with a flux density of less than one gauss) of 2700 plus or minus twenty percent; and with a saturation flux density at three oersteds and at twenty-five degrees centigrade, equal to or greater than 4400 gauss, and at three oersteds and at one hundred degrees centigrade equal to or greater than 3300 gauss; and with a Curie temperature of 210 degrees centigrade. During normal operation, the transformer operates at 0.18 Tesla.

Further characteristics of the transformer used with the Model NCA180 power supply are summarized as follows:

Core finish: epoxy coating with a minimum breakdown voltage of 1000 VDC across the flat surfaces of the core with an electrode clamp pressure of fifty pounds per square inch.

Core data: core outside diameter, 1.417 inches plus or minus 0.028 inch; core inside diameter 0.906 inch plus or minus 0.020 inch; magnetic path length 3.53 inches (8.97 centimeters); effective core area 0.15 inch squared (0.968 centimeters squared).

Transformer data: a space 1.875 inches in diameter may be allowed as the transformer footprint.

First winding layer

The primary winding with a four by seven No. 40 AWG braided tubular shield has twenty-one turns making a first complete layer on the core. The primary is finished with a circumferential insulating tape wrap. The primary wire may comprise nineteen strands of No. 29AWG silver-plated copper, having a tubular insulating covering of FEP Teflon with a wall thickness of about 0.010 inch, e.g. part number N22-29S-250 previously referred to (No. 16 AWG). When the tubular braided shield is included, the maximum outside diameter of each primary turn is 0.130 inch. The total length of the primary winding may be about three and one-half feet.

Second winding layer

The secondary winding is formed by fifteen bifilar turns of No. 14 AWG Litz wire, making one evenly spaced layer around the core over the first winding layer. The Litz wire may be formed from forty-two strands of No. 30 AWG insulated wires, the cross sectional area with Nylese insulation and equivalent to No. 14AWG, being 4200 circular mils, e.g. part number NELB42/30SPSN of New England Electric Wire Company. The total length of each secondary winding may be about three feet.

Outer Wrap: one outer circumferential wrap over the secondary winding layer.

Impregnation: vacuum impregnation; Scotch brand 280 or 237, semiflexible unfilled resin.

Isolation

Primary to secondary isolation sustains 1500 VAC for one minute at sixty Hertz. Similar isolation is provided from the primary winding to the braided tubular shield which fits closely on the primary wire.

Noise Performance

The noise performance of the NCA180 power supply was tested according to part 15J for Class A Computing Devices, of the Federal Communications Commission regulation 47 (FCC CFR 47. Pt15J) with and without the special four by seven No. 40 AWG tubular braided shield construction on the primary wire of the transformer. With the noise measured at the neutral side of the AC line and with the output resistor load receiving about two hundred watts in both cases, the transformer with the grounded shield construction essentially met Class B requirements over a frequency range from 0.45MHZ to 30 MHZ (except for a narrow band peak reaching 54dB, microvolts, at about 0.48 MHZ, and a series of three peaks in the vicinity of eighteen megahertz which exhibited a maximum value of about 54dB, microvolts); without the shield construction, the spectrum exceeded the Class B level over a band between about five megahertz and about sixteen megahertz, and exceeded the Class A level between about twelve and thirteen megahertz, reaching a peak of about 78dB (microvolts). Similar results were obtained when noise was measured at the hot side of the AC line, with and without the tubular shield construction, and with all other conditions the same as for the neutral side noise measurement.

It is concluded that using the shielded wire construction, the NCA180 power transformer achieves a goal of a noise spectrum ten decibels below the Class A standard, while without the shielded wire construction, a relatively elaborate noise filter would be required to meet such a goal. In certain applications where space is limited it is very desirable to avoid the larger size of an elaborate filter.

DESCRIPTION OF FIGS. 6 AND 7

In the exemplary embodiment of FIGS. 6 and 7, conductor 111 of an insulated primary wire corresponding to wire 10, FIG. 1, has an insulation covering 112, and is helically wrapped by a shield configuration 115 formed by seven groups such as 115-1 and 115-2 of twisted insulated shield wires, each group consisting of seven individually insulated shield wires which are tightly twisted together. The seven groups may be wrapped on the primary wire insulation 112 in side-by-side relationship so that the primary wire has a single shielding layer with a thickness equal to the diameter of the respective groups such as 115-1, and each turn of each group has a pitch equal to seven such diameters.

In FIG. 7, a transformer 120 is shown which electrically corresponds with the transformer 20 of FIG. 3. The primary wire construction of FIG. 6 is wrapped helically on a toroidal core 121 along with bifilar wound secondary wires 131 and 132. Free ends of the primary conductor 111 are indicated at 111*a* and 111*b*, FIG. 7, and respective adjacent ends of insulation covering 112 are indicated at 112*a* and 112*b*. The shield 115 has an end 115*a* where all of the shield wires, e.g. all forty-nine individual insulated shield wires, have their bare copper conductors connected electrically with a ground connector 117 which is to be connected to chassis ground. At an opposite end 115*b*, all the individual shield wires retain their individual insulation so as to be electrically isolated. Thus, ends 115*a* and 115*b* correspond with ends 15*a* and 15*b* in FIGS. 2 and 3, in being respectively connected at end 115*a* to chassis ground and at end 115*b* being in insulated open circuit condition.

The shielding construction 115, FIG. 6, may be formed by hand and yet provide a conductive coverage of the primary wire which is at least about eighty-five percent complete. The shield construction 15, FIG. 2, may be substituted for shield 115 in FIG. 7, and for example may comprise either a four by seven No. 40AWG braided tubular configuration or a tubular braid configuration formed of six groups of individually insulated wires, each group consisting of seven no. 40AWG wires each with a single Nyleze insulating covering. Such tubular braid configurations are considered to provide at least about ninety-five percent conductive coverage of the primary wire.

The following explanation concerning percent coverage may be given. If a series of uniformly axially spaced radial lines is visualized as extending from the central axis of the primary wire 10 in a given direction, ninety-five percent coverage would mean that ninety-five percent of such radial lines would intersect the copper or other conductive material of the shield wires for each different direction of the lines, while only five percent of the lines would extend through the shield without striking conductive material.

In order to assure a relatively high percentage coverage of the primary wire, it is desirable to have a substantial number of shield wires in the shield configuration. Where each individual shield wire has its own insulating coating, eddy current losses are minimized. It is advantageous therefore if a shield wire conductive cross section corresponding to a diameter of about one-tenth millimeter has an insulating covering about 0.01 millimeter thick. As a specific example, for each of the illustrated embodiments a shield wire conductive cross section corresponding to a diameter of about 0.08 millimeter may have a total cross section including insulation corresponding to a diameter of about one-tenth millimeter.

In general the shield configurations as described herein may shield the primary winding with respect to capacitive coupling of noise to the secondary windings so as to substantially reduce the transmission of noise to the secondary circuit in the frequency range between ten and thirty megahertz, e.g. by from ten to twenty decibels, where the separation between Class B and Class A standards (FCC CFR 47. Pt15J) is about eighteen decibels. These preferred results are obtained with a total shield thickness of about twenty-five mils, the shield wires having a conductive diameter of about three mils, to present a ratio of about eight to one.

The core configuration 21, FIG. 3 or 121, FIG. 7, may be of homogeneous ferrite material as previously explained or may be formed of a thin continuous strip of suitable metallic magnetic material e.g. of nickel-iron composition, or may be formed of thin amorphous metal alloy magnetic strip material, spirally wound to form the desired toroidal core thickness and suitably insulated to reduce eddy current losses, the resulting tape-wound magnetic core being covered e.g. with an insulating coating such as a thin epoxy-type, protective coating which results in a so-called GVB encased core.

From the foregoing, it will be understood that a feature of the present invention resides in the provision of a shielded wire construction for use in switching power supplies, and particularly in a power transformer construction for such switching power supplies which may be energized, e.g., by generally rectangular waveforms of alternating polarity such as indicated at 40, FIG. 5, and having a frequency above twenty kilohertz. While heretofore, for the purpose of compliance with paragraph 9A of UL478, Fifth Edition, (i.e. Sections 9A.3 and 9A.4), E-shaped magnetic cores with a planar gap therebetween filled by a planar copper sheet have been used for providing shielding between primary and secondary windings; according to a feature of the present invention, it is possible to use a one piece (gap-free) toroidal magnetic core with interlaced or superimposed toroidally wound primary and secondary windings, while still achieving the required isolation between the primary and secondary circuits.

Another feature of the present invention relates to a shielded wire construction which reduces the stray capacitance between the turns of the primary winding, reducing the stress on switching elements in the primary circuit, and reducing electromagnetic interference generated by the transformer (such as 20, FIG. 3, or 120, FIG. 7) during operation. Elimination of excessive stray capacitance reduces the current spike imposed on switching elements at the beginning of each half cycle, and suppresses incoming transients and line noise.

Another feature of the invention resides in a shielded wire construction which reduces the stray capacitance from primary to secondary, even though such primary and secondary windings are wound in common on a toroidal core for example as illustrated in FIG. 7. It is considered that the shield configuration of the present invention provides the advantageous properties of a Faraday shield, drastically reducing the danger of incoming noise transients being coupled to the secondary circuits (since such transients are diverted to ground via the shield wires of the shield 15 or 115 and the connecting ground conductor 17, or 117, which connects to ground as indicated at 17A FIG. 3.)

In a toroidal core transformer construction implemented without the use of the preferred shield construction, winding a copper shielding strip along each turn of the primary winding so as to separate such turn from an adjoining turn of a secondary winding would be impractical. For example, with such an arrangement eddy current losses would be relatively high because of the large conductive surface area, reducing the coupling between the primary and secondary windings particularly at high frequencies, or where the volts per turn ratio is great, because of heating of the transformer. Further a breakdown of the insulation between the ends of the copper shielding strip would produce a shorted turn linking the magnetic path, resulting in failure of the transformer. With a shield according to the present invention with a multiplicity small cross section insulated wires, eddy current losses are much lower, providing a high degree of coupling between the primary and secondary windings even for high power operation at relatively high frequencies. Further there are a multiplicity of insulating barriers between the relatively fine shield wires and operability does not depend on the integrity of a single insulating barrier.

By way of example, the ratio of the thickness of a shield such as 15 or 115 to the total cross sectional dimension or diameter of the individual insulated shield wires may be at least about three to one, and by way of preferred example, may be about six to one. The insulation for an individual shield wire conductor (whether stranded or solid) may have a thickness which is not more than about fifteen percent of the conductive cross sectional dimension of such individual shield wire.

The Underwriters Laboratory Provision UL-478 is entitled "Information-Processing and Business Equipment". Various materials which may be utilized for providing an insulating coating on the shield wires such as 16 are given in Table 9-2 at pages 190, 191 and 192 of a text by Smith entitled "Magnetic Components Design and Application" published by Van Nostrand-Reinhold Company, 1985.

In general as in U.S. Pat. No. 4,439,256, the number of conductors in the shield 15 will not usually exceed forty-eight, and generally each shield wire will have a conductor core of copper or aluminum. Ideally, the shield wires 16 will be so packed as to provide at least 85% coverage of the primary wire 10 by the conductive material (e.g. copper) of the shield. Also, in general, the shield wires may consist of a solid conductive core coated with an organic insulating material, it being understood, however, that multi-strand conductive cores may also be used beneficially. The insulation may be provided by any natural or synthetic organic dielectric resinous material conventionally used for wire coating purposes, exemplary of which are polyurethane, polyester, polyimide, nylon, polyvinyl formal, varnish, and the like, and it will be appreciated that copolymers and interpolymers, as well as multilayer composite coatings, may be suitable and are encompassed. The potential application and frequency requirements for the shielded wire configuration of the present invention will dictate the size and number of component shield conductors, and the construction of the principal or central signal carrying wire 10, FIG. 1. Generally, for the shield wires, gauge sizes (AWG) from forty-eight to twelve will be suitable, depending of course upon whether the wire is solid or of multi-strand construction. While the number of shield wires may range from four to sixty (or possibly more, in certain instances), most typically the shielded construction 15, FIG. 2, or 115, FIG. 6, will be composed of from fifteen to fifty shield wires. The insulation on the shield wires will normally be about one-half mil (about 0.01 millimeter) to about two mils thick (about 0.05 millimeter), again depending upon the gauge of the conductive core.

In another example of a transformer according to the present invention, the secondary winding means 20B, 20C, FIG. 3, or 131, 132, FIG. 7, may also be encased in a tubular shield configuration such as shown at 15 in FIG. 2, or 115, FIG. 6. Such a transformer is useful for common mode rejection in matching transformers for data transmission operations. These are small signal type transformers. Common mode rejection would be used to "uncover" the desired signal from associated noise, i.e. remove the noise by common mode rejection. To accomplish this the ground lead 17A, FIG. 3, is disconnected from ground and connected to the phase lead of the primary winding, e.g. to primary conductor portion **11*b*, FIG. 3; or the connector 117, FIG. 7 is connected to primary conductor portion 111*b*. The shield of the secondary winding is then grounded as shown at 17, FIG. 2, for the shield 15, and as shown at 117, FIG. 6, for the shield 115, the line 17 or 117 being bonded electrically to the secondary ground terminal, e.g. terminal 24, FIG. 3. The two shields as so connected accomplish common mode rejection for the noise component. For such data transmission matching transformers, the toroidal magnetic core 21 or 121** may again be essentially free of gaps for improved magnetic coupling between the primary and secondary windings both of which physically link the gap-free loop magnetic circuit.

It will be apparent that many modifications and variations may be effected without departing from the scope of the teachings and concepts of the present invention.

I claim as my invention:

1. A transformer construction comprising magnetic core means with a primary winding linking said magnetic core means, said primary winding having shield means formed of multiple shield wires substantially enclosing the primary winding, each shield wire having electrical insulation means covering the shield wire and electrically insulating such shield wire from the other shield wires of the shield, the shield wires having respective adjacent first ends electrically connected to ground potential and being otherwise in open circuit insulated relationship so as to provide a shield having the properties of a Faraday Shield for said primary winding.

2. The transformer construction according to claim 1, each shield wire having an individual insulating coating to form an individually insulated shield wire and being interwoven with other individually insulated shield wires about the cross section of the primary winding such that the shield essentially encloses the primary winding.

3. The transformer construction according to claim 2, each individually insulated shield wire having a first end with the individual insulating coating thereon at a first end of the primary winding and a second end without the individual insulating coating thereon at a second end of the primary winding, said first ends of said individually insulated shield wires being electrically separate from each other and being covered with electrical insulating material, and the second ends of the individually insulated shield wires being directly connected together, electrically, for connection to ground.

4. The transformer construction according to claim 1, said primary winding having successive spaced primary turns and a secondary winding being comprised of secondary turns interposed between the primary turns.

5. The transformer construction according to claim 1, said shield means electrically isolating said primary winding to protect secondary circuits coupled with said primary winding from electric shock hazard according to the requirements of UL478, fifth edition, paragraph 9A.

6. The transformer construction according to claim 5, with said magnetic core means providing an essentially gap free loop magnetic circuit, and secondary winding means linking said annular magnetic core means physically close to said primary winding for close coupling with said primary winding without detrimental capacitive coupling therebetween.

7. The transformer construction according to claim 6, with said shield means presenting a generally uniform thickness dimension in covering relation to said primary winding, the shield wires having a cross sectional dimension such that the ratio of the thickness dimension of the shield means to such cross sectional dimension of the shield wires is at least about three to one, said shield means presenting no closed loop conductive paths for eddy currents so as to avoid any substantial adverse effect on inductive coupling between the primary winding and the secondary winding means.

8. The transformer construction according to claim 7, with said shield means providing conductive material covering at least about eighty five percent of each turn of said primary winding.

9. The transformer construction according to claim 1, with said shield means presenting a generally uniform thickness dimension in covering relation to said primary winding, the shield wires having a cross sectional dimension such that the ratio of the thickness dimension of the shield means to such cross sectional dimension of the shield wires is at least about three to one.

10. The transformer construction according to claim 1, with said shield means providing conductive material covering at least about eighty-five percent of each turn of said primary winding.

11. The transformer construction according to claim 1, with secondary winding means also having a shielding means formed of multiple shield wires which substantially encloses individual turns of said secondary winding means.

12. The transformer construction according to claim 11, with the shield wires of the shield means for the primary winding and for secondary winding means being connected to produce common mode rejection of noise associated with a signal supplied to the primary winding.

13. The transformer construction according to claim 1, said shield being grounded at one end and having the properties of a Faraday shield for shielding said primary winding with respect to capacitive coupling.

14. A shielded wire construction comprising an elongated electrical conductor means for galvanically transmitting a fluctuating electric current therealong, and elongated electrically conductive shield means extending along said elongated electrical conductor means in shielding relation thereto and electrically insulated therefrom, said electrically conductive shield means being comprised of multiplicity of shield wires insulated from each other and in open circuit relation at one end of the shield means and connected in common to ground at the other end of the shield means, said elongated electrical conductor means having termination means at an end thereof so as to be connectable with a source a fluctuating electric current, and means comprising said termination means for adapting said elongated electrical conductor means for the transmission of fluctuating electric current therealong.

15. The shielded wire construction according to claim 14, each shield wire having an individual insulating coating to form an individually insulated shield wire.

16. The shielded wire construction according to claim 15, the individually insulated shield wires being interwoven to form a conductive barrier.

17. The shielded wire construction according to claim 16, the conductive barrier providing at least about eighty-five percent conductive coverage of the elongated electrical conductive means.

18. The shielded wire construction according to claim 14, said elongated electrical conductor means comprising a stranded wire conductor with a covering of electrical insulation having a thickness of about one-fourth millimeter separating the stranded wire conductor from the shield means.

19. The shielded wire construction according to claim 18, each shield wire having a conductive cross section with a cross sectional dimension of about 0.08 millimeter.

20. The shielded wire construction according to claim 19, each shield wire having a total cross section with a cross sectional dimension of about one-tenth millimeter.

21. The shielded wire construction according to claim 14, said shield wires forming a tubular shield configuration essentially conductively enclosing said electrical conductor means.

22. A shielded wire construction according to claim 27, with said elongated electrical conductor means and said elongated electrically conductive shield means having a common central axis forming a plural turn winding configuration without substantial eddy current losses even at frequencies of the order of forty kilohertz.

23. The shielded wire construction according to claim 14, characterized by the requirement for operation at relatively high frequencies but with relatively low eddy current losses, said elongated electrical conductor means transmitting fluctuating electric current having a relatively high frequency component in the kilohertz range without excessive eddy current losses 24. The construction according to claim 23, the shield means forming a conductive barrier providing at least about eighty-five percent conductive coverage of the elongated electrical conductor means.

25. The construction according to claim 23, with the electrically conductive shield means having a general thickness dimension covering the elongated electrical conductor means about its periphery, the shield wires which are insulated from each other having a maximum conductive cross sectional dimension, and the ratio between said general thickness dimension and the maximum conductive cross sectional dimension of one of said shield wires being about eight to one.

26. The construction according to claim 23, with said elongated electrical conductor means and said elongated electrically conductive shield means being free of substantial eddy current losses even at frequencies of the order of forty kilohertz.

27. The shielded wire construction according to claim 23, said elongated electrical conductor means together with said elongated electrically conductive shield means being sufficiently compact and flexible so as to be formed into a loop configuration and into close mechanical and magnetic coupling with a cooperating means.

28. The shielded wire construction according to claim 27, further comprising a magnetic core serving as the cooperating means and having said elongated electrical conductor means together with said elongated electrically conductive shield means mechanically formed in a loop thereon and inductively coupled therewith.

29. The shielded wire construction according to claim 23, said elongated electrical conductor means together with said elongated electrically conductive shield means being suitable for winding on a magnetic core and having its electrically conductive shield means essentially providing the exterior dimension which is to be bent during winding thereof.

30. The shielded wire construction according to claim 23, having an operating frequency above twenty kilohertz.

31. In a shielded wire construction, elongated electrical conductor means for galvanically conducting alternating polarity power supply current, and an elongated electrically conductive shield essentially surrounding said elongated electrical conductor means and electrically insulated therefrom, said elongated electrically conductive shield being comprised of a plurality of shield wires arranged in an essentially enclosing shield configuration which essentially encloses the elongated electrical conductor means, each shield wire of the essentially enclosing shield configuration having electrical insulation means covering the shield wire and electrically insulating such shield wire from other shield wires of the essentially enclosing shield configuration, said elongated electrically conductive shield providing the properties of a Faraday shield for shielding said elongated electrical conductor means, the shield wires at one end of the elongated electrically conductive shield being electrically connected to ground potential and the shield wires at the opposite end of the elongated electrically conductive shield being disposed in open circuit insulated relationship.

32. The shielded wire construction according to claim 31, each shield wire having an individual insulating coating to form an individually insulated shield wire extending from the one end to the opposite end of said elongated electrically conductive shield.

33. The shielded wire construction according to claim 32, the individually insulated shield wires being interwoven to form the enclosing shield configuration.

34. The shielded wire construction according to claim 33, said elongated electrical conductor means comprising a stranded wire conductor with a covering of electrical insulation having a thickness of about one-fourth millimeter separating the stranded wire conductor from the interwoven individually insulated shield wires.

35. The shielded wire construction according to claim 32, each individually insulated shield wire having a conductive cross section with a diameter of about 0.08 millimeter.

36. The shielded wire construction according to claim 35, each individually insulated shield wire having a total cross section with a diameter of about one-tenth millimeter.

37. The shielded wire construction according to claim 32, each individually insulated shield wire having a first end with individually insulating coating thereon at a first end of the electrically conductive shield and a second end without the individual insulating coating thereon at a second end of the electrically conductive shield, said first ends of said individually insulated shield wires being covered with electrical insulating material, and the second ends of the individually insulated shield wires being directly connected together electrically and electrically connected in common to ground potential.

38. The shielded wire construction according to claim 37, said elongated electrical conductor means having its conductor axis extending in successive turns to form a coil with a first coil end and a second coil end, and said elongated electrical conductor means conducting alternating polarity power supply current along the successive turns of the coil, the first ends of the individually insulated shield wires being at the first coil end of the coil and the second ends of the individually insulated shield wires being at the second coil end of the coil.

39. The shielded wire construction according to claim 31, said elongated electrical conductor means being in the form of multiple turns with said elongated electrically conductive shield providing reduced stray capacitance between the turns.

40. The shielded wire construction according to claim 31, said electrically conductive shield providing the properties of Faraday shield for shielding said elongated electrical conductor means with respect to capacitive coupling.

41. A shielded wire construction comprising an elongated electrical conductor means for galvanically transmitting a fluctuating electric current therealong, and elongated electrically conductive shield means extending along said elongated electrical conductor means in shielding relation thereto and electrically insulated therefrom, said electrically conductive shield means being comprised of a multiplicity of shield wires insulated from each other and in open circuit relation at one end of the shield means and connected in common to ground at the other end of the shield means, said elongated electrical conductor means consisting essentially of copper material for transmitting the fluctuating electric current therealong, and said elongated electrically conductive shield means being located in a tubular space about the copper material, said tubular space being substantially filled with said shield wires and being essentially free of electrical conductors which are not connected in common to ground at said other end of said shield means.

42. A shielded wire construction comprising an elongated electrical conductor means for galvanically transmitting a fluctuating electric current therealong, and elongated electrically conductive shield means extending along said elongated electrical conductor means in shielding relation thereto and electrically insulated therefrom, said electrically conductive shield means being comprised of a multiplicity of shield wires insulated from each other and in open circuit relation at one end of the shield means and connected in common to ground at the other end of the shield means, source means coupled with said elongated electrical conductor means and supplying fluctuating electric current to said elongated electrical conductor means for transmission therealong.

43. A shielded wire construction comprising an elongated electrical conductor means for galvanically transmitting a fluctuating electric current therealong, and elongated electrically conductive shield means extending along said elongated electrical conductor means in shielding relation thereto and electrically insulated therefrom, said electrically conductive shield means being comprised of a multiplicity of shield wires insulated from each other and in open circuit relation at one end of the shield means and connected in common to ground at the other end of the shield means, said elongated electrical conductor means transmitting said fluctuating electric current at a central cross section region, and the cross section area between the central cross section region and the outermost perimeter of the cross section occupied by said shield wires being essentially passive and entirely clear of power transmitting conductor which transmit substantial power, from one end of the electrically conductive shield means to the other end.

44. An electromagnetic structure comprising a primary winding galvanically conducting alternating polarity power supply current for energizing said primary winding, said primary winding comprising elongated electrical conductor means having its axis extending in successive spaced turns and galvanically conducting said alternating polarity power supply current as primary electrical current, a secondary winding comprised of secondary turns interposed between the spaced turns forming said primary winding, and an elongated electrically conductive shield separating the secondary winding from the elongated electrical conductor means to provide reduced capacitive coupling between the primary and secondary windings, said elongated electrically conductive shield essentially surrounding said elongated electrical conductor means and being electrically insulated therefrom, said elongated electrically conductive shield being comprised of a plurality of shield wires arranged in an essentially enclosing shield configuration which essentially encloses the elongated electrical conductor means, each shield wire of the essentially enclosing shield configuration having electrical insulation means covering the shield wire and electrically insulating such shield wire from other shield wires of the essentially enclosing shield configuration.

45. The electromagnetic structure according to claim 44, with said elongated electrical conductor means conducting power supply current of a frequency of at least about forty kilohertz.

46. The electromagnetic structure according to claim 44, said elongated electrical conductor means together with the essentially enclosing shield configuration forming a plural turn primary winding configuration without substantial eddy current losses even at frequencies of the order of forty kilohertz.

47. The electromagnetic structure according to claim 44, said electrically conductive shield being effective for protecting secondary circuits from electric shock hazard according to the requirements of UL478, fifth edition, paragraph 9fA.

48. The electromagnetic structure according to claim 44, with said elongated electrical conductor means conducting power supply current of a frequency of at least about forty kilohertz, said electrically conductive shield being effective for protecting secondary circuits from electric shock hazard according to the requirements of UL478, fifth edition, paragraph 9A.

49. The electromagnetic structure according to claim 44, said electrically conductive shield providing the properties of a Faraday shield for shielding said primary transformer winding with respect to capacitive coupling, and substantially reducing the transmission of incoming noise or transients to said secondary winding.

50. The electromagnetic structure according to claim 44, said elongated electrically conductive shield providing the properties of a Faraday shield for shielding said elongated electrical conductor means, the shield wires at one end of the elongated electrically conductive shield being electrically connected to ground potential and the shield wires at the opposite end of the elongated electrically conductive shield being disposed in open circuit insulated relationship.

51. The electromagnetic structure according to claim 50, said elongated electrical conductor means together with the essentially enclosing shield configuration forming a plural turn primary winding configuration without substantial eddy current losses even at frequencies of the order of forty kilohertz.

52. The electromagnetic structure according to claim 50, said electrically conductive shield being effective for protecting secondary circuits from electric shock hazard according to the requirements of UL478, fifth edition, paragraph 9A.

* * * * *